US011391035B2

(12) United States Patent
Hammond et al.

(10) Patent No.: US 11,391,035 B2
(45) Date of Patent: Jul. 19, 2022

(54) MODULAR BUILDING SYSTEM

(71) Applicant: BUILDING IP HOLDINGS PTY LTD, Brisbane (AU)

(72) Inventors: John Hammond, Brisbane (AU); Gregory Irvine, Brisbane (AU)

(73) Assignee: BUILDING IP HOLDLNGS PTY LTD

( * ) Notice: Subject to any disclaimer, the term of this patent is extended or adjusted under 35 U.S.C. 154(b) by 0 days.

(21) Appl. No.: 17/047,048

(22) PCT Filed: Dec. 20, 2018

(86) PCT No.: PCT/AU2018/051368

§ 371 (c)(1),
(2) Date: Oct. 12, 2020

(87) PCT Pub. No.: WO2019/195874

PCT Pub. Date: Oct. 17, 2019

(65) Prior Publication Data

US 2021/0156143 A1 May 27, 2021

(30) Foreign Application Priority Data

Apr. 13, 2018 (AU) ..... 2018901234
Aug. 13, 2018 (AU) ..... 2018902943

(51) Int. Cl.
*E04B 1/343* (2006.01)
*E04B 1/14* (2006.01)
(Continued)

(52) U.S. Cl.
CPC ..... *E04B 1/34321* (2013.01); *E04B 1/14* (2013.01); *E04B 2/58* (2013.01); *E04B 2/789* (2013.01); *E04C 2/384* (2013.01); *E04C 2/46* (2013.01)

(58) Field of Classification Search
CPC . E04B 1/14; E04B 1/08; E04B 1/0015; E04B 1/34321; E04B 2/58; E04B 2/789;
(Continued)

(56) References Cited

U.S. PATENT DOCUMENTS 2,137,767 A * 11/1938 Betcone ..... E04B 2/58 52/274
3,377,756 A * 4/1968 Polhamus ..... H02G 3/105 52/220.7

(Continued)

FOREIGN PATENT DOCUMENTS

| | | |
|---|---|---|
| GB | 2451275 | 1/2009 |
| KR | 101769060 | 8/2017 |
| WO | 20170214382 | 12/2017 |

OTHER PUBLICATIONS

International Preliminary Report on Patentability for Application No. PCT/AU2018/051368 dated Aug. 13, 2020.

(Continued)

*Primary Examiner* — Jessie T Fonseca
(74) *Attorney, Agent, or Firm* — Tumey L.L.P.

(57) ABSTRACT

A modular building construction system comprising a plurality of panels, each panel having two spaced apart sheets; an insulating core portion positioned between said spaced apart sheets, wherein edge portions of the spaced apart sheets define a hollow cavity, the cavity extending along peripheral portions of the panel wherein the panel comprises a length (l) and a height (h) wherein top and bottom channel members face outwardly and extend along the length (l) of the panel and are positioned in respective hollow cavities along in-use top and bottom peripheral portions of the panel respectively; and wherein first and second opposite side channels face outwardly and extend along the height (h) of the panel and are positioned in respective hollow cavities along each of the lateral peripheral portions of the panel
(Continued)

respectively and wherein during use the channel members are adapted to be interconnected with one or more building elements positioned along said peripheral portions.

18 Claims, 15 Drawing Sheets

(51) Int. Cl.
*E04B 2/58* (2006.01)
*E04B 2/78* (2006.01)
*E04B 2/00* (2006.01)
*E04C 2/38* (2006.01)

(58) Field of Classification Search
CPC .... E04B 2/7453; E04B 7/026; E04B 2103/06; E04C 2003/0473; E04C 2/28; E04C 2/46; E04C 2/384; E04C 2/521
See application file for complete search history.

(56) References Cited

U.S. PATENT DOCUMENTS 3,411,252 A * 11/1968 Boyle, Jr. ..... E04B 2/825 52/126.4
3,591,993 A * 7/1971 Reeves ..... E04B 2/62 52/584.1
4,161,087 A * 7/1979 Levesque ..... E04C 2/384 52/210
4,274,242 A * 6/1981 Linton ..... E04B 1/08 52/309.11
4,720,948 A * 1/1988 Henley ..... E04B 1/74 52/404.3
5,007,222 A * 4/1991 Raymond ..... E04B 1/0023 52/220.1
5,279,089 A * 1/1994 Gulur ..... E04B 7/22 52/284
5,555,698 A * 9/1996 Mandish ..... E04B 2/58 52/348
7,882,672 B2 * 2/2011 Emblin ..... E04C 2/34 52/426
8,065,846 B2 * 11/2011 McDonald ..... E04B 5/10 52/281
2007/0245640 A1 * 10/2007 Bergqvist ..... E02D 27/12 52/92.2
2008/0209827 A1 * 9/2008 Webb ..... E04B 2/821 52/220.7
2009/0165416 A1 * 7/2009 Porter ..... E04C 3/083 52/481.1
2012/0144774 A1 * 6/2012 Andrews ..... E04B 2/767 52/783.1
2019/0100917 A1 * 4/2019 Malinowski ..... E04B 1/2403

OTHER PUBLICATIONS

International Search Report and Written Opinion of the International Searching Authority for Application No. PCT/AU2018/051368 dated Mar. 14, 2019.
Written Opinion of the International Preliminary Examining Authority for Application No. PCT/AU2018/051368 dated Oct. 22, 2019.
Written Opinion of the International Preliminary Examining Authority for Application No. PCT/AU2018/051368 dated Mar. 14, 2019.

* cited by examiner

MODULAR BUILDING SYSTEM

TECHNICAL FIELD

The present invention relates to a modular building system and a modular panel system including building panels that are configured to allow construction workers to quickly construct a low-cost and durable building structure. The present invention also relates to building elements used in conjunction with the modular building system.

BACKGROUND

Any references to methods, apparatus or documents of the prior art are not to be taken as constituting any evidence or admission that they formed, or form part of the common general knowledge.

There are many conventional construction techniques currently in use in the small building and housing industries. These techniques include wood frame construction, masonry frame construction, and light-gauge steel construction. Each of these construction techniques has its own advantages and disadvantages, taking into consideration various factors such as cost, energy efficiency, durability, aesthetics, difficulty of assembly, and reliance upon special tools or components which may be necessary for assembly.

Wood frame construction is currently the most commonly used system for residential construction. Although wood frame construction is commonly used, such construction methods are time consuming and labour intensive. Wood as a construction material remains relatively inexpensive. However, there is also a growing concern over the quality and quantity of the world's dwindling wood supply.

In view of the above, it is desirable to provide improvements for modular construction of buildings.

SUMMARY OF INVENTION

In an aspect, the invention provides a modular building construction system comprising a plurality of panels, each panel having two spaced apart sheets; an insulating core portion positioned between said spaced apart sheets, wherein edge portions of the spaced apart sheets define a hollow cavity, the cavity extending along peripheral portions of the panel wherein the panel comprises a length (l) and a height (h) wherein top and bottom channel members face outwardly and extend along the length (l) of the panel and are positioned in respective hollow cavities along in-use top and bottom peripheral portions of the panel respectively; and wherein first and second opposite side channels face outwardly and extend along the height (h) of the panel and are positioned in respective hollow cavities along each of the lateral peripheral portions of the panel respectively and wherein during use the channel members are adapted to be interconnected with one or more building elements positioned along said peripheral portions.

In an embodiment, the one or more panels are substantially rectangular.

In an embodiment, one or more of said channel members comprises a substantially U-shaped cross-section, the channel members being adapted to receive a building element into a recess defined by the channel wherein during use the building element is fastened to walls defining the channel.

In an embodiment, walls of the channel members are fastened to the spaced apart sheets and/or the insulating core.

In an embodiment, one or more of the channel members comprises: a base wall that is fastened to the core portion of the panel; and opposed upstanding walls that are spaced apart and fastened to inner surfaces of the sheets.

In an embodiment, the channel members are adhesively bonded to the core portion and/or the opposed sheets.

In an embodiment, outer edge portions of the opposed sheets extend beyond the core portion to define said hollow cavities extending along peripheral portions of the panel.

In an embodiment, the spaced apart sheets and the insulating core are substantially non-metallic and wherein the one or more channel members are substantially metallic.

In an embodiment, the one or more building elements comprises an upright connecting assembly adapted to be received into the opposite side channels, the upright connecting assembly comprising:

an upright with one or more outer side walls extending between an in use-upper portion and an in use-lower portion along a height of the upright;

the upper portion further comprising an upwardly extending connecting arrangement with spaced apart portions to allow a beam to be positioned transversely relative to the upright; and the lower portion further comprising a downwardly extending male connecting member structured to be received into a channel of an in-use bottom plate positioned below said assembly.

In an embodiment, the upright is adapted to be received in adjacently positioned side channels of panels in adjacent side by side relationship wherein during use the upright is adapted to be fastened to the adjacent side channels of the panels in said adjacent side by side relationship.

In an embodiment, walls of the channel of the in-use bottom plate are adapted to be received into the bottom channel members of the one or more panels and wherein during use the bottom channel members are fastened to the walls of the channel of the bottom plate.

In an embodiment, the top channel members of the panels are adapted to receive the beam thereby allowing the beam to be positioned transversely relative to the upright and wherein during use, the top channel members of the panels are fastened to the beam.

In an embodiment, the upright comprises a substantially hollow configuration.

In an embodiment, the upright comprises a substantially rectangular configuration with first and second pairs of opposed side walls extending along the height of the upright.

In an embodiment, at least two opposed side walls extend upwardly from the upper portion of the upright to define a space there-between and form the connecting arrangement to receive and support the beam in the transverse position relative to the upright.

In an embodiment, the upright connecting assembly further comprises one or more downwardly extending male connecting members, said male connecting members being inwardly recessed relative to the side walls of the upright.

In an embodiment, the male connecting member comprises connecting side walls depending downwardly from the upright, the connecting side walls being stepped or recessed inwardly relative to the outer side walls of the upright.

In an embodiment, the male connecting member comprises at least two of said connecting side walls, wherein said two connecting side walls are spaced apart.

In an embodiment, the spaced connecting sidewalls are joined by an additional connecting side wall extending there-between.

In an embodiment, each connecting side wall of the male connecting member lies in a plane that is parallel to a plane of a corresponding outer side wall of the upright.

In an embodiment, the upright comprises a first elongate upright member comprising a substantially U-shaped profile that is received lengthwise in a second elongate upright member.

In an embodiment, the second elongate upright member also comprises a substantially U shaped profile.

In an embodiment, each of the first and second upright member comprises two opposed side walls and a base wall such that the opposed side walls extend from the base wall and wherein each of said opposed side walls and base wall of the respective upright member extend along the height of the upright.

In an embodiment, each of the opposed side walls of the upright are substantially perpendicular to the base wall of the upright.

In another aspect, the invention provides a building panel comprising: two spaced apart sheets; an insulating core portion positioned between said spaced apart sheets, wherein edge portions of the spaced apart sheets define a hollow cavity extending along peripheral portions of the panel wherein the panel comprises a length (l) and a height (h) wherein top and bottom channel members face outwardly and extend along the length (l) of the panel and are positioned in respective hollow cavities along in-use top and bottom peripheral portions of the panel respectively; and wherein first and second opposite side channels face outwardly and extend along the height (h) of the panel and are positioned in respective hollow cavities along each of the lateral peripheral portions of the panel respectively and wherein during use the channel members are adapted to be interconnected with one or more building elements positioned along said peripheral portions.

In an embodiment, the one or more channel members comprise a substantially U-shaped cross-section and are adapted to receive a building element into a recess defined by the channel member wherein during use the building element is fastened to walls defining the channel member.

In an embodiment, the length (l) of the spaced apart sheets is greater than length of the core portion of the panel thereby allowing the edge portions of the spaced apart sheets to define a hollow cavity extending along in-use top and bottom peripheral portions of the panel.

In an embodiment, height (h) of the spaced apart sheets is greater than height of the core portion thereby allowing the edge portions of the spaced apart sheets to define a hollow cavity extending along in-use opposed side peripheral portions of the panel.

In another aspect, the invention provides an upright connecting assembly for use in modular construction of buildings, the assembly comprising:

an upright with one or more outer side walls extending between an in use-upper portion and an in use-lower portion along a height of the upright;

the upper portion further comprising an upwardly extending connecting arrangement with spaced apart portions to allow a beam to be positioned transversely relative to the upright; and the lower portion further comprising a downwardly extending male connecting member structured to be received into a channel of a plate positioned below said assembly.

In yet another aspect, the invention provides a method of modular building construction by using a plurality of panels, each panel having two spaced apart sheets; an insulating core portion positioned between said spaced apart sheets, wherein edge portions of the spaced apart sheets define a hollow cavity, the cavity extending along peripheral portions of the panel wherein the panel comprises a length (l) and a height (h) wherein top and bottom channel members face outwardly and extend along the length (l) of the panel and are positioned in respective hollow cavities along in-use top and bottom peripheral portions of the panel respectively; and wherein first and second opposite side channels face outwardly and extend along the height (h) of the panel and are positioned in respective hollow cavities along each of the lateral peripheral portions of the panel respectively, the method comprising the steps of:

positioning a bottom plate on an underlying building surface upon which the modular building is to be constructed, the bottom plate comprising upstanding walls defining a channel;

securing said bottom plate to the underlying building surface;

positioning the upstanding walls of the bottom plate in engagement with the bottom channel and fastening the bottom channel to the bottom using one or more fasteners.

In an embodiment, the method further comprises the steps of:

providing an upright connecting assembly in between adjacently positioned side channels of panels in adjacent side by side relationship; and fastening said upright connecting assembly to the side channels of the panels in said adjacent side by side relationship.

In an embodiment of the method, the upright connecting assembly comprises an upright with one or more outer side walls extending between an in use-upper portion and an in use-lower portion along a height of the upright; the upper portion further comprising an upwardly extending connecting arrangement with spaced apart portions to allow a beam to be positioned transversely relative to the upright; and the lower portion further comprising a downwardly extending male connecting member structured to be received into the channel of the bottom plate.

In an embodiment, the method further comprises the step of:

positioning a beam in between the spaced apart portions in a transverse configuration relative to the upright such that one or more sections of the beam are also received into one or more top channel members of the panels in adjacent side by side relationship; and fastening the beam to the one or more top channel members.

In another aspect, the invention comprises an upright connecting assembly for connecting two construction panels in an angled configuration, the assembly comprising:

an upright with a plurality side walls extending along a height of the upright, the upright extending between an in use-upper portion and an in use-lower portion;

the upper portion further comprising:

a first upper connecting arrangement with a first pair of spaced apart portions to allow a beam to be positioned in a first transverse position relative to the upright; and a second upper connecting arrangement with a second pair of spaced apart portions to allow a beam to be positioned in a first transverse position relative to the upright the lower portion further comprising:

a first downwardly extending male connecting member structured to be received into a first channel positioned below said assembly; and a second downwardly extending male connecting member structured to be received into a second channel positioned below said assembly.

In yet another aspect, the invention comprises an upright connecting assembly for installing a window or a door during modular construction of a building, the assembly comprising:

an upright with one or more outer side walls extending between an in use-upper portion and an in use-lower portion along a height of the upright;

the upper portion further comprising an upwardly extending connecting arrangement to connect with a channel of a window or door supporting member, said member being arranged transversely relative to the upright;

the lower portion further comprising a downwardly extending male connecting member structured to be received into a channel of a plate positioned below said assembly.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

FIGS. 1 to 4 illustrates isolated views of a panel 100 for use in a modular building construction system 100. The panel 100 is a rectangular building panel having two spaced apart sheets 105 and 110 with an insulating core portion 115 sandwiched between said spaced apart sheets 105 and 110. The edge portions of the spaced apart sheets 105 and 110 define a hollow cavities extending along peripheral portions of the rectangular panel 100 (best shown in FIGS. 1 and 2).

Figure 1:
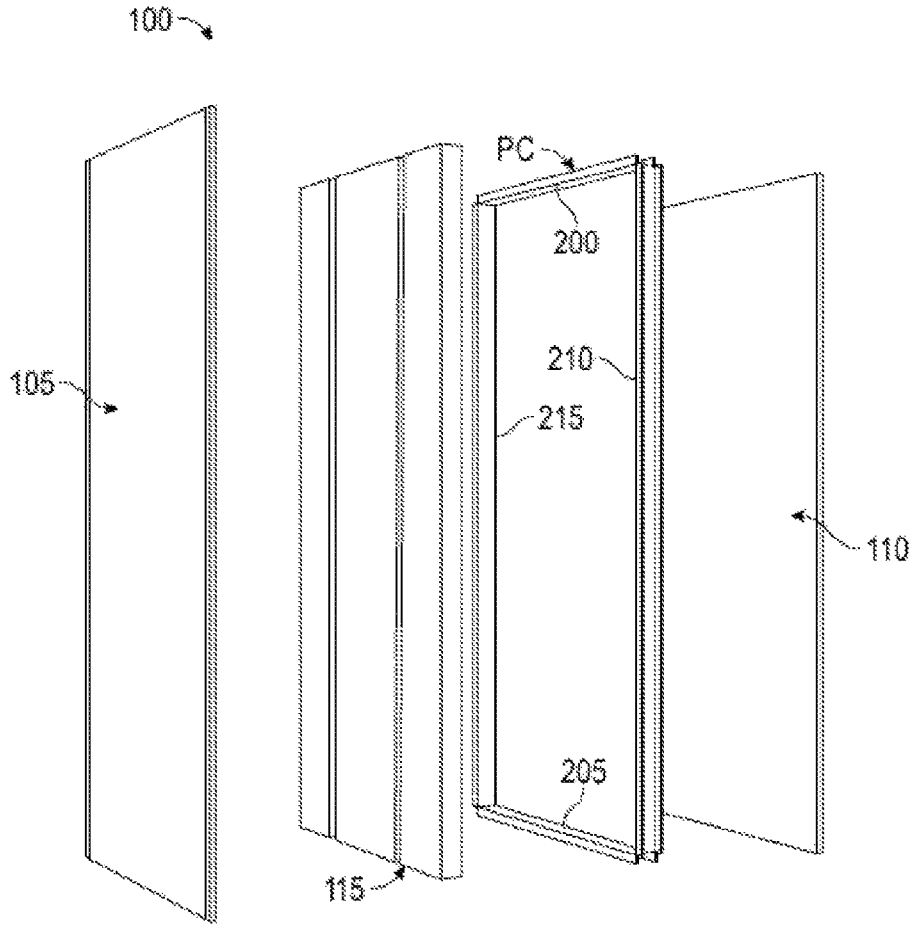
FIG. 1 is an exploded view of a panel 100 in accordance with an embodiment of the present invention.
Figure 2:
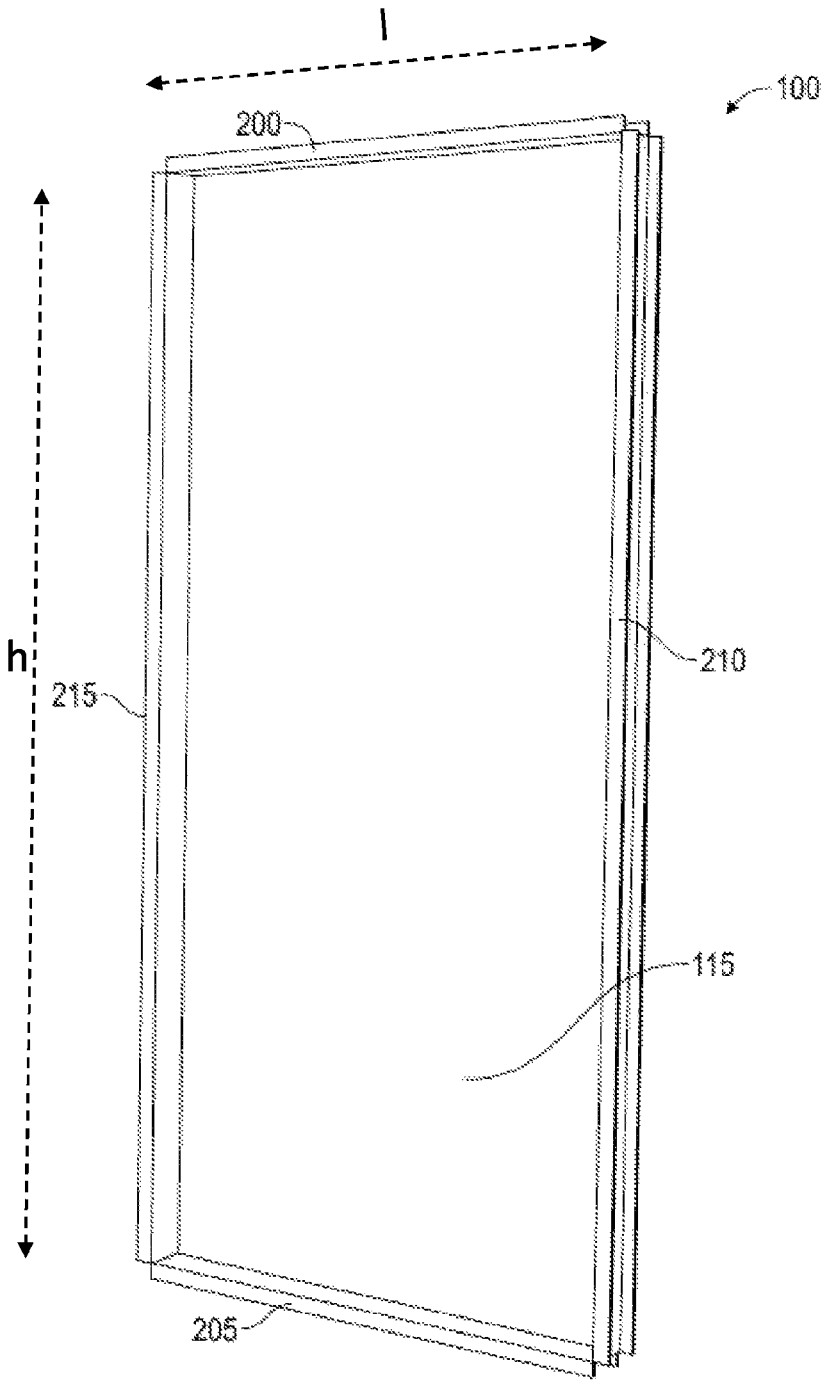
FIG. 2 is a perspective view of a panel 100 in accordance with an embodiment.
Figure 3:
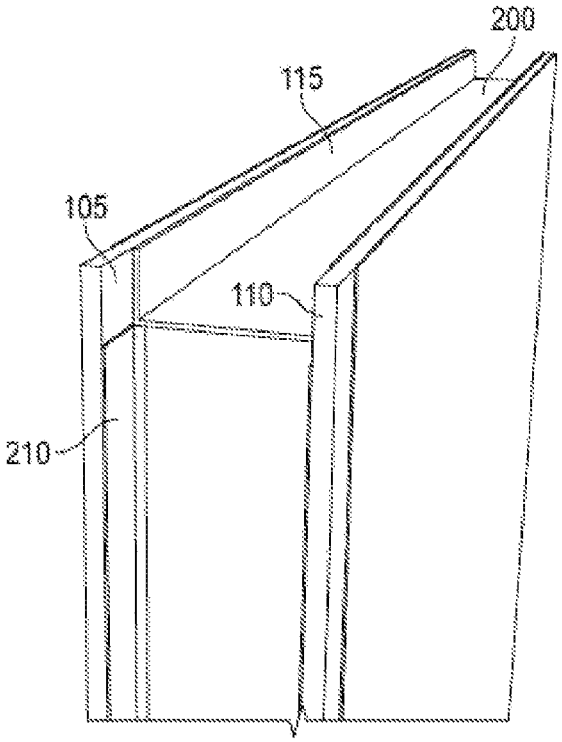
FIG. 3—is a top perspective view (enlarged) of the panel 100.
Figure 4:
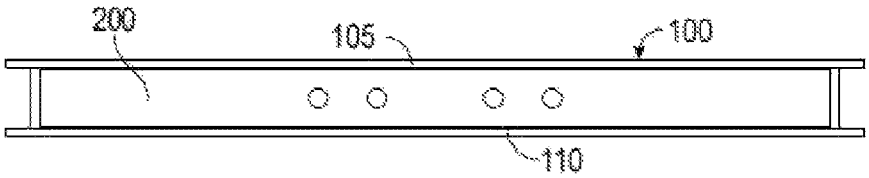
FIG. 4 is a top view of the panel 100.

Each rectangular panel 100 comprises a length (l) and a height (h) as shown in FIG. 2. Top and bottom channel members 200 and 205 face outwardly and extend along the length (l) of the panel and are positioned in respective hollow cavities along in-use top and bottom peripheral portions of the panel 100. Similarly, first and second opposite side channels 210 and 215 face outwardly and extend along the height (h) of the panel 100 and are positioned in respective hollow cavities along each of the lateral peripheral portions of the panel 100 respectively. As will be evident from the description in the foregoing sections, each of the channel members 200, 205, 210 and 215 are adapted to be interconnected with one or more building elements positioned along the peripheral portions of the panel 100 during construction of the modular building construction system 1000.

A typical panel 100 comprises a core of fire resistant expanded polystyrene that is sandwiched between the two sheets 105 and 110. The sheets may be made from any known construction material that is preferably lightweight, fire-resistant and provides insulation. The panel 100 may be provided in a range of sizes. By way of example, the width of the panel may be about 300 mm-1100 mm and the height of panel may be 2400 mm, 2700 mm or 3000 mm. The panel 100 is an internal wall panel which is symmetrical about a vertical axis such that any panel can be turned upside down or back to front.

Figure 6:
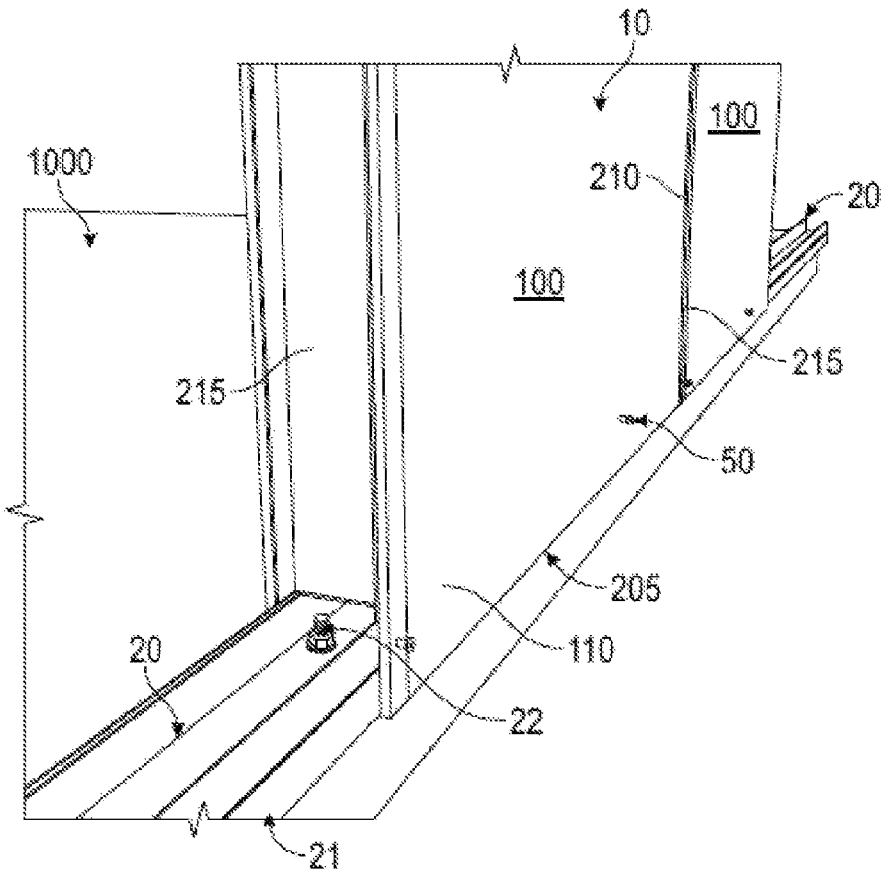
FIG. 6 is an enlarged perspective view of the building system 100 shown in an in-use configuration.

As shown in FIG. 6, the panel 100 (in at least some embodiments) includes an external wall sheet 110 that extends further when compared to the internal wall sheet 105 in order to conceal a concrete slab or floor system. As previously discussed, channel members or elements 200, 205, 210 and 215 extend along perpendicular edges of the panel 100. Each channel element 200 has a substantially U-shaped cross section with a base wall which is fastened to the core portion 115 of the panel 100 and spaced apart upstanding walls which are fastened to inner surfaces of the sheets 105 and 110. In the preferred embodiment, the channel members/elements are glued to the core (not shown) and the sheets 105, 110 of the panel 100 providing increased structural integrity of the panel 100. However, other methods may also be used for fixing the channel members/elements to the core 115 and the sheets 105 and 110 without departing from the invention. In the preferred embodiment, the channel elements 200, 205, 210 and 215 are metallic and are bonded to the sheets 105 and 110 along the upstanding wall portion of each U-shaped channel member/element.

Figure 5:
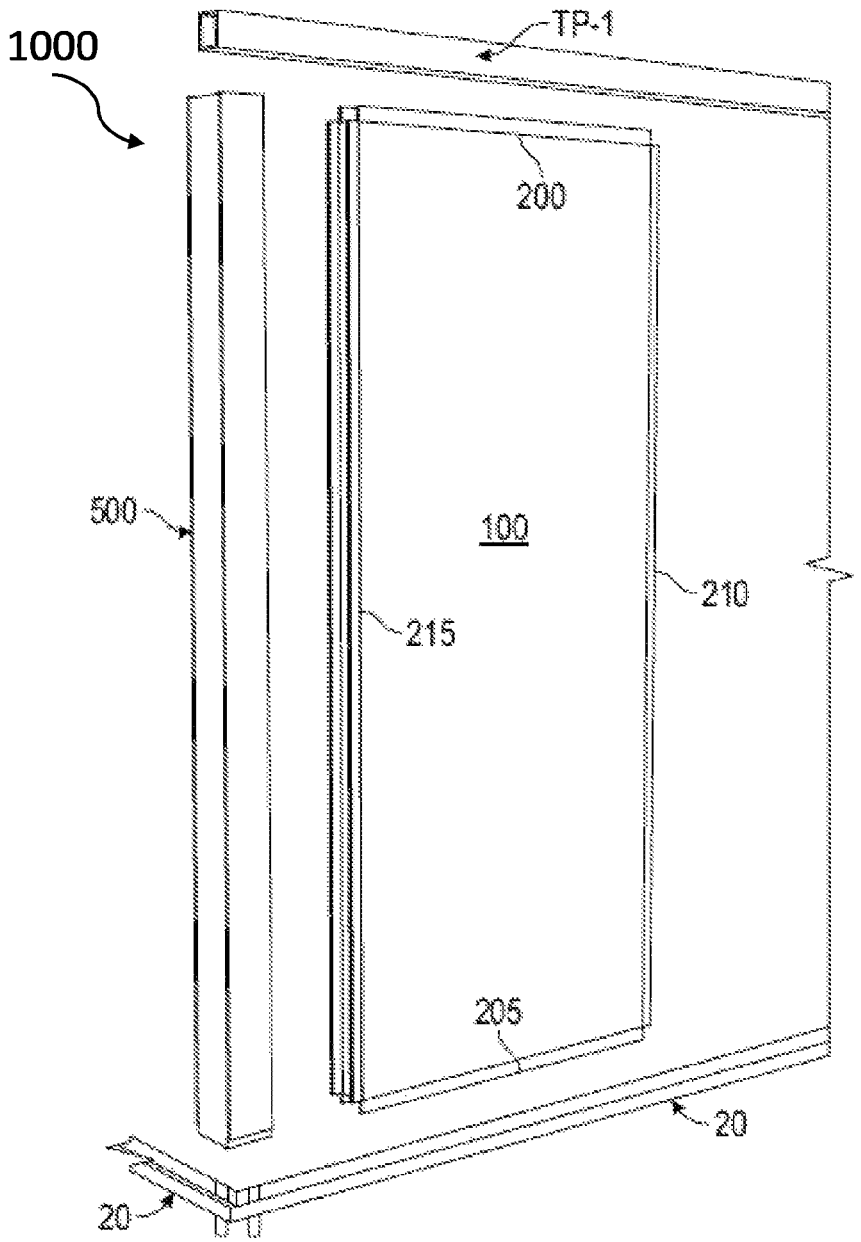
FIG. 5 is an exploded view of an embodiment of a building system 1000.
Figure 11A:
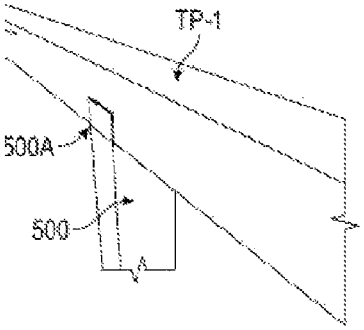
FIGS. 11A and 11B are enlarged perspective views of the upper portion 500A of the upright connector 500 shown in two separate configurations.
Figure 11B:
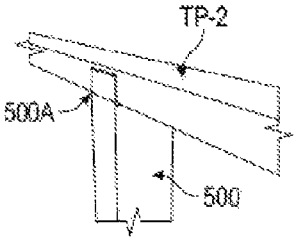
Figure 12:
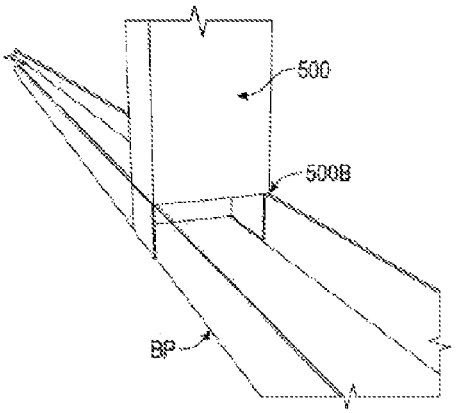
FIG. 12 is an enlarged perspective view of the lower portion 500B of the upright connector 500.
Figure 13A:
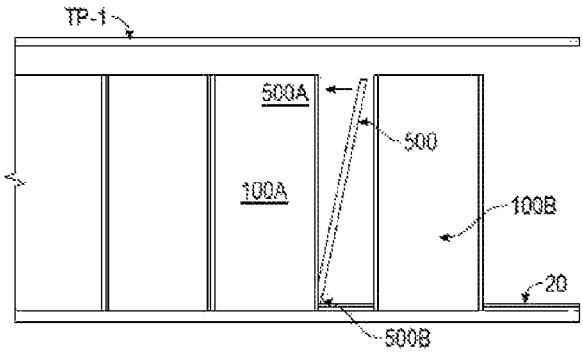
FIGS. 13A to 13D depict a method for installing the upright connector 500 to connect panels 100A and 100B.
Figure 13B:
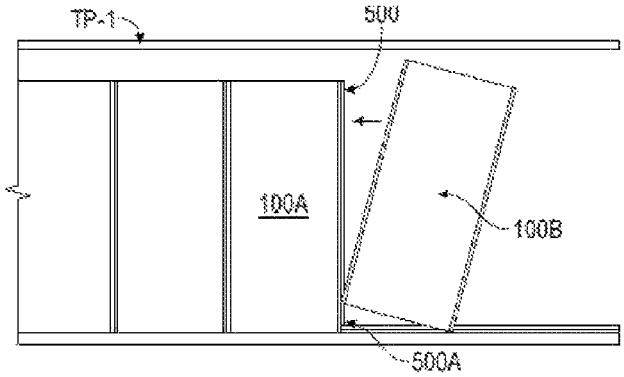
Figure 13C:
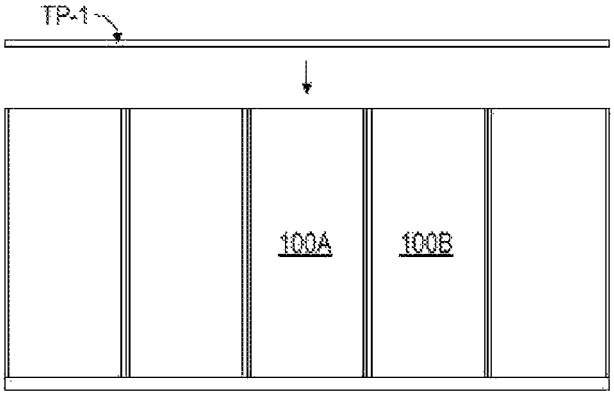
Figure 13D:
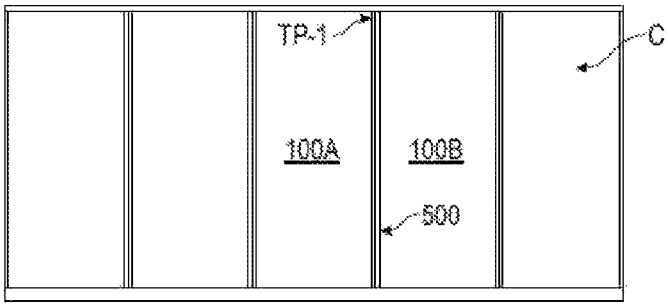

Referring to FIGS. 5 and 6, erecting the building system 1000 involves installation of the panel 100 which requires positioning a bottom plate 20 on an underlying slab. The bottom plate 20 (shown in FIG. 7—isolated view) includes upstanding wall portions 201 and 202 which define a U-shaped channel in the bottom plate 20. During installation of the panel 100, the bottom channel element 205 connects and receives the upstanding wall portions 201 and 202 of the bottom plate 20. Specifically, upstanding wall portions 201 and 202 are aligned contiguously along the downwardly dependent wall portions of the bottom channel element 205. Fasteners in the form of screws 50 may be used to fasten the bottom channel element 205 to the bottom plate 20 by inserting the screws 50 into the external sheet 110 of the panel 100. The inventors have found that the provision of the Such an arrangement Turning to FIGS. 8 to 12, an upright connecting assembly in the form of an upright adaptor 500 is illustrated. The upright adaptor 500 is provided in the aforementioned modular building system 100 for two non-limiting purposes. First, the upright adaptor 500 functions as a connector to inter-connect two panels 100 in a side-by-side configuration (best shown in FIGS. 13A to 13D). Second, the upright adaptor 500 also functions as a structural member by supporting a transverse beam that is provided in the form of a top plate (TP-1 or TP-2 as shown in FIGS. 11A and 11B). TP-1 is a load bearing member and comprises a relatively greater height and width when compared with TP-2. It is envisioned that TP-1 may be useful for supporting an additional floor whereas TP-2 may be better suited for single-story construction.

Figure 8:
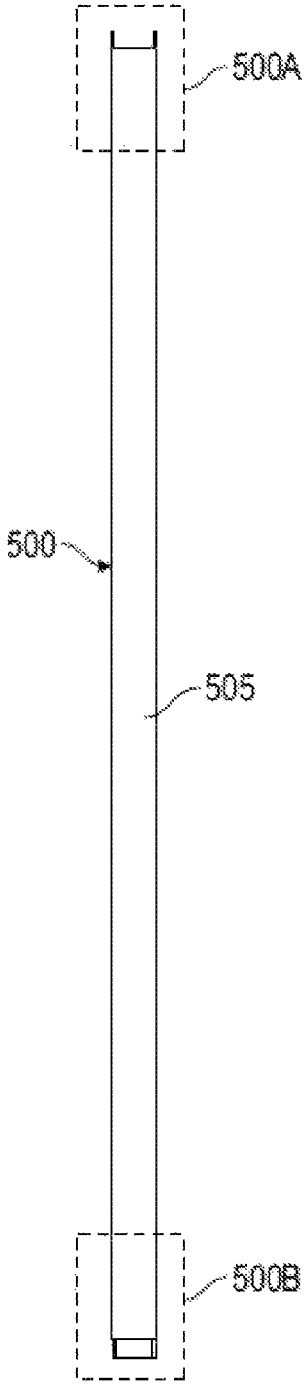
FIG. 8 is a side view of an upright connector 500 in accordance with an embodiment of the present invention.
Figure 8A:
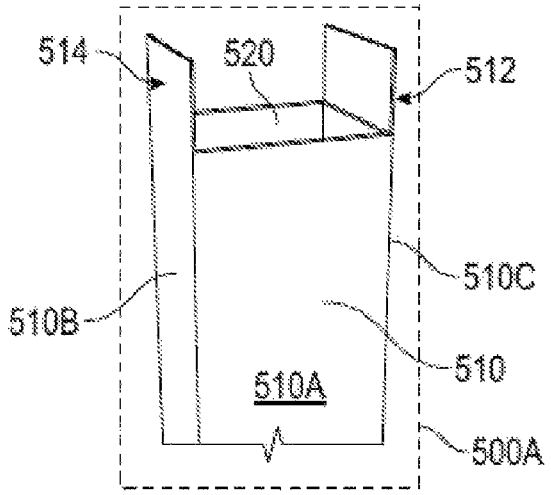
FIG. 8A is an enlarged perspective view of an in-use upper portion 500A of the upright connector 500.

Referring to FIGS. 8, 8A, 8B, 9 and 10, the upright adaptor/connector 500 comprises an upright 505 with outer side walls extending along a height of the upright between an in use-upper portion 500A and an in use-lower portion 500B. Referring to FIG. 8A, the upper portion 500A comprises an upwardly extending connecting arrangement with opposed spaced apart side wall portions 512 and 514 to allow a beam (such as TP-1 or TP-2 as shown in FIGS. 11A and 11B) to be positioned transversely relative to the upright adaptor 500. The lower portion 500B comprises a downwardly extending male connecting member 522 that is structured to be received into a channel of the bottom plate 20 positioned below the upright adaptor 500. The male connecting member 522 is inwardly recessed relative to the outer side walls of the upright 505. The male connecting member 522 comprises connecting side walls 520A, 520B and 520C depending downwardly from the upright 505. As shown most clearly in FIG. 8B, the connecting side walls 520A, 520B and 520C are stepped or recessed inwardly relative to the outer side walls 510A, 510B and 510C of the upright 505.

Figure 8B:
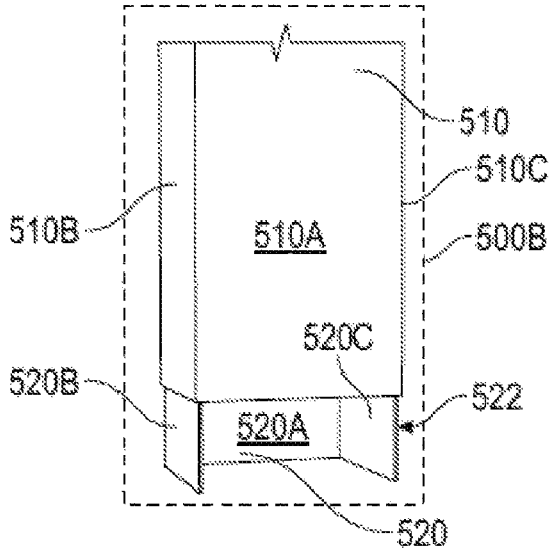
FIG. 8B is an enlarged perspective view of an in-use lower portion 500B of the upright connector 500.
Figure 9:
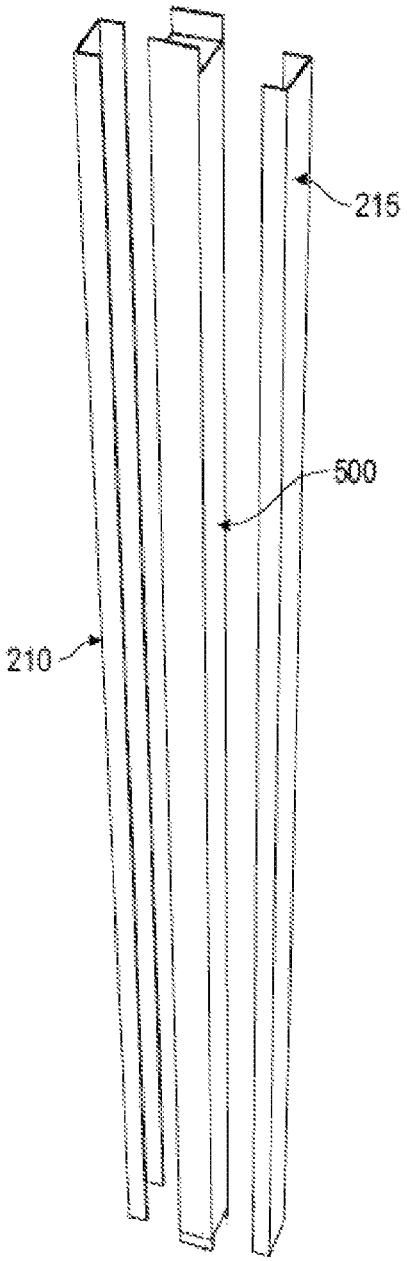
FIG. 9 is an exploded view of the upright connector 500 relative to the side channels 210 215 of two adjacent panels (now shown).
Figure 10:
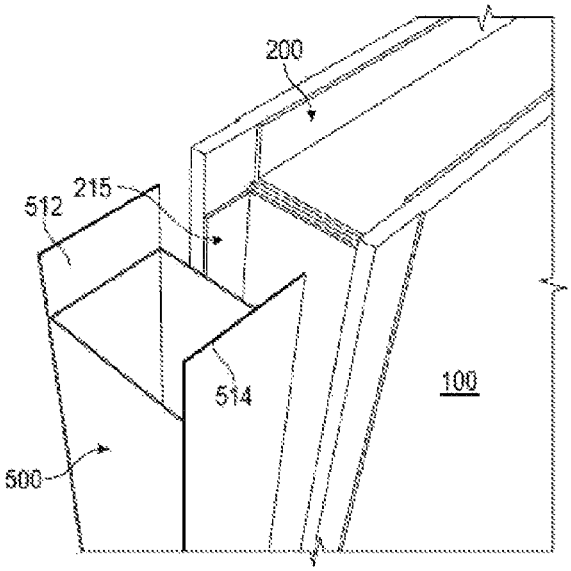
FIG. 10 is a top perspective in-use view of the upright connector 500 and the panel 100 in the building system 1000.

Advantageously, the upright adaptor 500 is constructed from two elongate C-shaped sections 510 and 520. A first elongate upright member 520 comprising a substantially C-shaped or U-shaped profile is received lengthwise into a second elongate upright member 510 which also comprises a substantially C-shaped or U-shaped profile. The first C-shaped upright member 520 comprises side walls 520B and 520C that extend in an upwardly direction from a base wall 520A. A portion of the side walls 520A, 520B and 520C extends beyond the edges of the second upright member 520 and forms the outwardly extending male connecting portion 522 (as shown in FIG. 8B). The second upright member 510 also comprises opposed side walls 510A and 510C and extend from the base wall 510A. Once again, each of the opposed side walls 510A and 510B and base wall 510A of the second upright member 510 extend along the height of the upright 505. Each of the spaced apart portions 512 and 514 are a part of the opposed side walls 510B and 510C respectively and extend beyond an upper end portion of the base wall 510A of the second upright 510 to accommodate the top plate TP-1 or TP-2 (See FIGS. 11A and 11B). In other embodiments, the upright connector 500 may be constructed from tubes or any other material without necessarily using two C-shaped sections.

Figure 7:
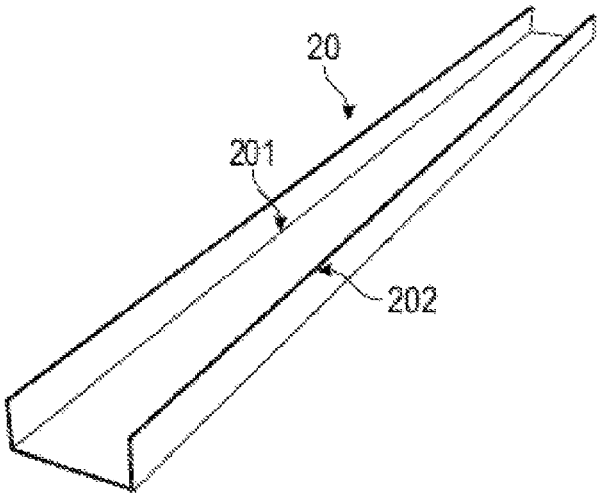
FIG. 7 is an isolated view of a bottom plate 20 which forms a part of the building system 1000.

Referring to FIGS. 13A to 13D, a step-wise method has been illustrated to show the manner in which the upright connector/adaptor 500 is used for installing and inter-connecting panels 100 during construction of the modular building 1000. The first step (FIG. 13A) involves positioning a first panel 100A (a fixed panel) on the bottom plate 20 followed by positioning a lower portion 500B of the upright connector 500 into a channel portion of the bottom plate 20 (as shown in FIGS. 6 and 7). The second step (shown in FIG. 13B) involves positioning the upright portion 505 along the side channels (210 or 215) of the fixed panel 100A such that a substantial part of the upright 505 is positioned within the C-shaped opening of the side channel of the fixed panel 100A. The third step and fourth steps (FIGS. 13C and 13D) involves positioning a second panel 100B in close relationship with the initially fixed panel 100A with the upright connector 500 positioned in an upright configuration in between said panels 100A and 100B. The top plate TP-1 is subsequently positioned into the top channel of the panels 100A, 100B such that it is positioned transversely relative to the upright connector 500. As previously discussed (and shown in FIG. 11A), the top plate TP-1 is received in between the spaced apart upper portions 512 and 514 of the upright connector 500.

Figure 14A:
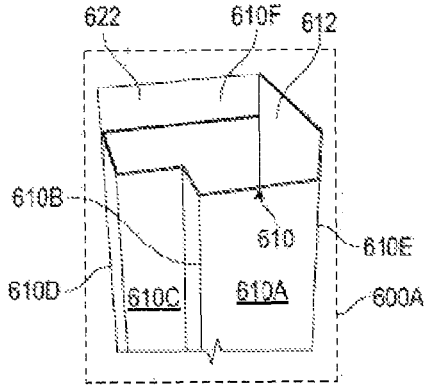
FIG. 14A is an enlarged perspective view of an in-use upper portion 600A of the upright connector 600.
Figure 15A:
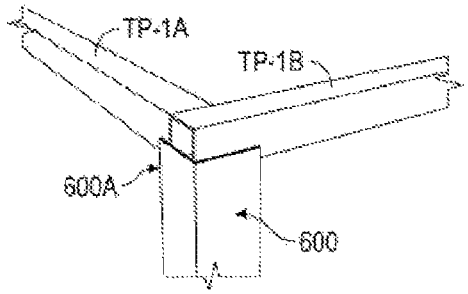
FIGS. 15A and 15B are enlarged perspective views of the upper portion 600A of the upright connector 600 shown in two separate configurations.
Figure 15B:
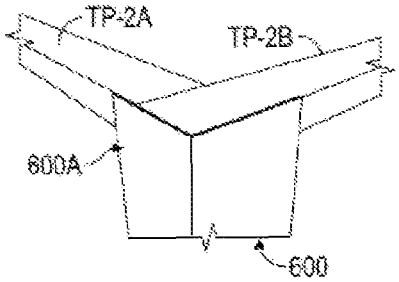
Figure 14:
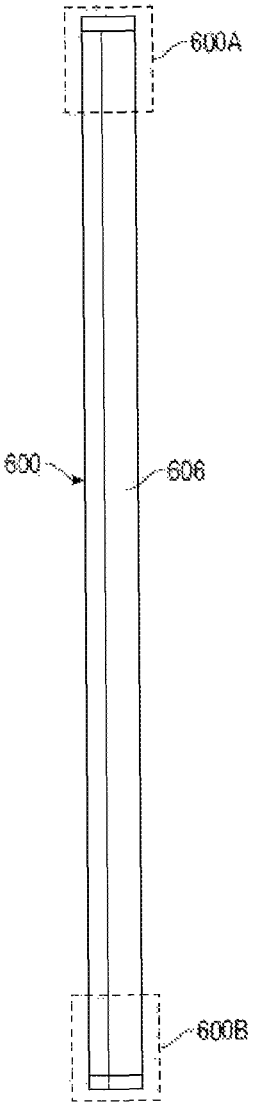
FIG. 14 is a side view of an upright connector 600 in accordance with an embodiment of the present invention.
Figure 14B:
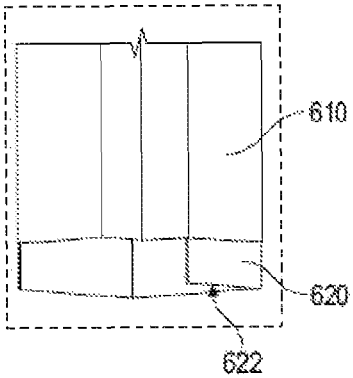
FIG. 14B is an enlarged perspective view of an in-use lower portion 600B of the upright connector 600.
Figure 16:
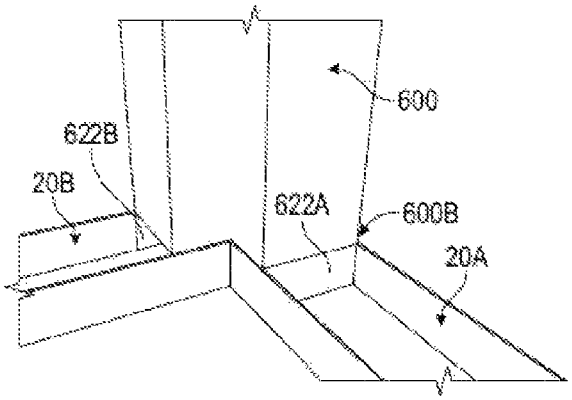
FIG. 16 is an enlarged perspective view of the lower portion 600B of the upright connector 600.

Referring to FIGS. 14 to 16, a second embodiment of a corner upright connector 600 is illustrated. The corner upright connector 600 is particularly helpful for inter-connecting two of the previously described panels 100 in an angled configuration. During construction of a building, it is often necessary to erect two wall panels in angled configuration to define a corner of a building. In the presently described embodiment, the upright connector 600 has been shown for inter-connecting two adjacent panels 100 in a substantially perpendicular configuration. Referring to FIGS. 14, 14A and 14B, the upright connector 600 includes an upright 606 having a plurality of side walls that extend along a height of the upright 606 in between an in-use upper portion 600A and an in-use lower portion 600B.

The upper portion 600A (detailed view shown in FIG. 14A) includes outwardly extending upper wall portions 622 and 612 are located along adjacent side walls 610 that have a slightly greater height relative to the remaining upper edge portions of side walls 610A, 610B, 610C and 610D. The provision of the upwardly extending upper wall portions 622 and 612 allows two top plates (TP1-A and TP1-B or TP2-A and TP-2B-See FIGS. 8A and 8B) to be positioned transversely (relative to the upright 606) in an angled configuration along the same direction as the wall panels. As previously discussed, TP-1A and TP-1B are load bearing members and each member comprises a relatively greater height and width when compared with TP-2A and TP-2B. It is envisioned that TP-1A and TP-1B may be useful for supporting angled walls with an additional floor thereabove. TP-2A and TP-2B may be better suited for single story construction.

The upright connector 600 also includes a lower portion 600B (detailed view shown in FIG. 14B) with two downwardly extending male connecting members 622A and 622B (denoted generally by feature 622) that are structured to be received into channels of respective bottom plates 20A and 20B as shown in FIG. 16. The upright connector 600 assists with the construction of buildings having wall panels in an angled configuration. The aforementioned configuration of the upright connector 600 allows panels (such as panel 100), bottom plates 20A, 20B and the top plates (either TP1-A and TP1-B or TP2-A and TP-2B) to be positioned in any angled (non-collinear) configuration.

Figure 17:
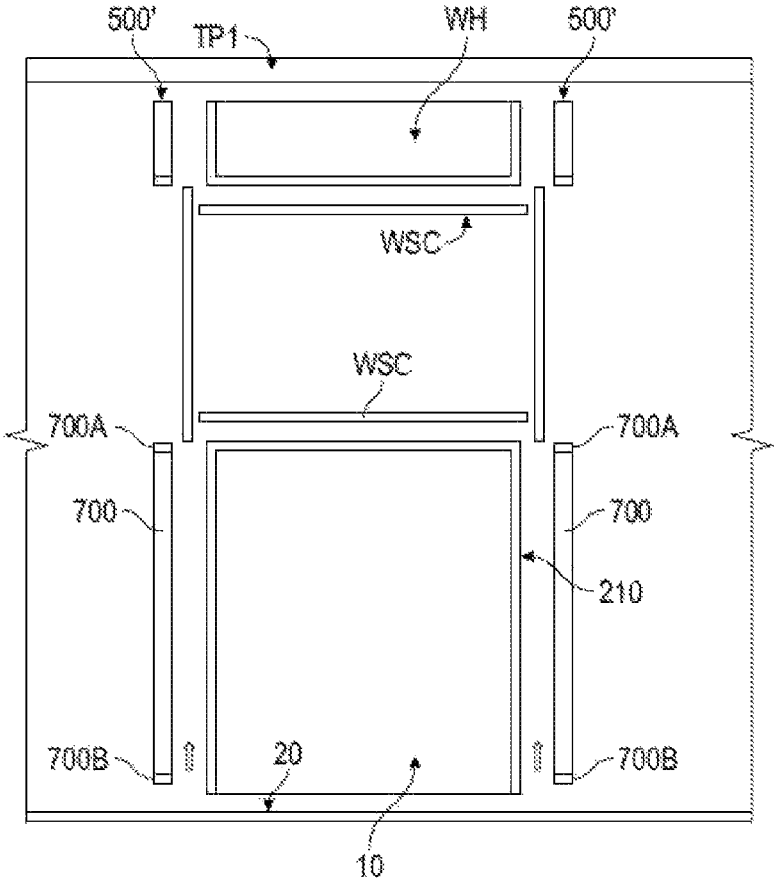
FIG. 17 is an exploded view of a window opening utilising upright connectors 500' and 700.
Figure 18:
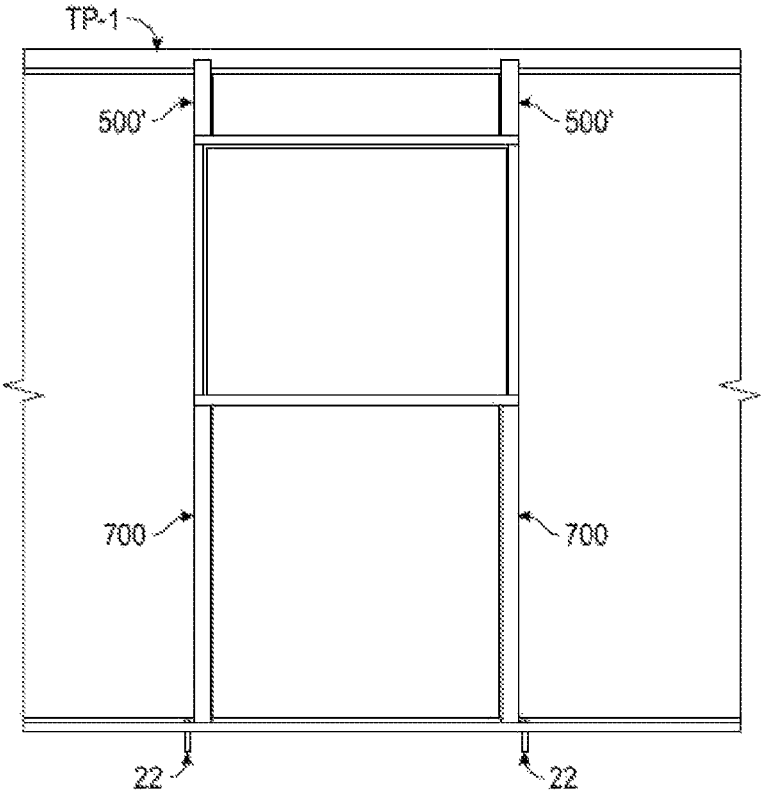
FIG. 18 is a frontal view of the window opening utilising upright connectors 500' and 700.

Referring to FIGS. 17 to 19 (19A and 19B), another embodiment of an upright connector 700 is illustrated. The upright connector 700 is particularly suitable for installing a window during modular construction of a building. Each upright connector 700 comprises sidewalls extending between an in-use upper portion 700A and an in-use lower portion 700B (as shown in FIGS. 17 and 18). Each of the upper and lower portions 700A and 700B include male connecting members that are structured to be received in a window sill channel (WSC) and the bottom plate 20 respectively. A typical installation of a window in an opening also requires the use of additional upright connectors 500' that have a substantially similar configuration as upright connector 500 (that has been previously described). The only difference relates to the overall height of these upright connectors 500' which is much lesser than height of the previously described upright connectors 500.

Figure 19A:
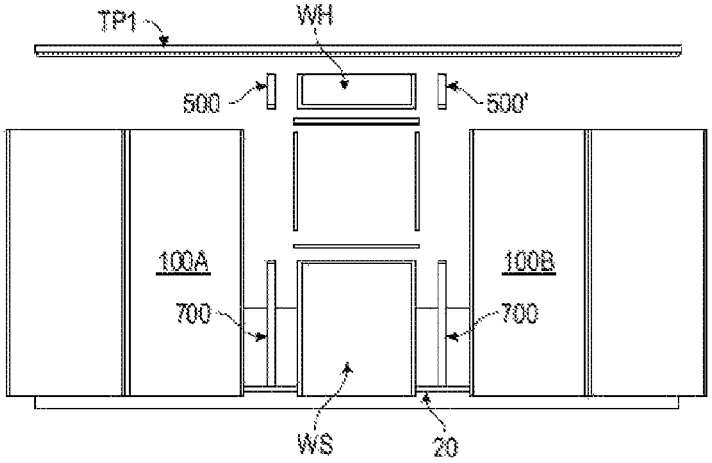
FIGS. 19A to 19D illustrate a method for installing a window opening by utilising upright connectors 500' and 700.
Figure 19B:
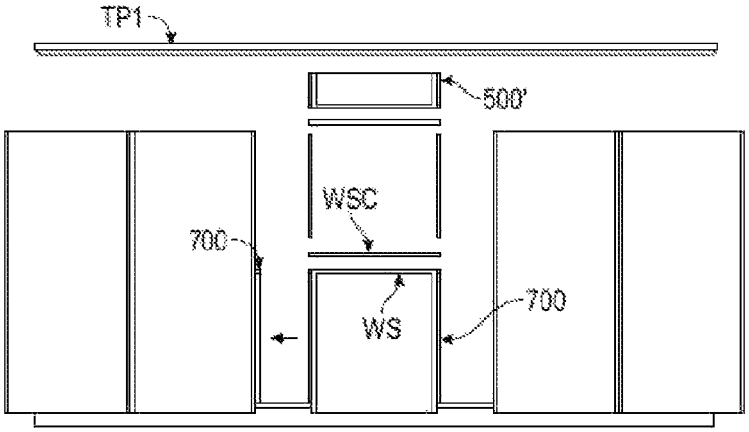
Figure 19C:
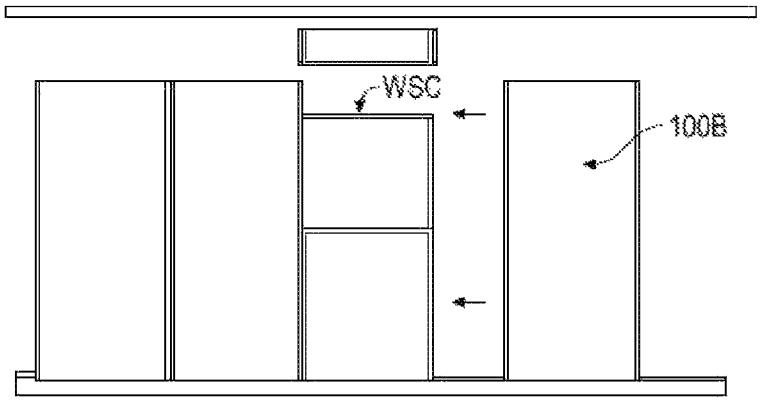
Figure 19D:
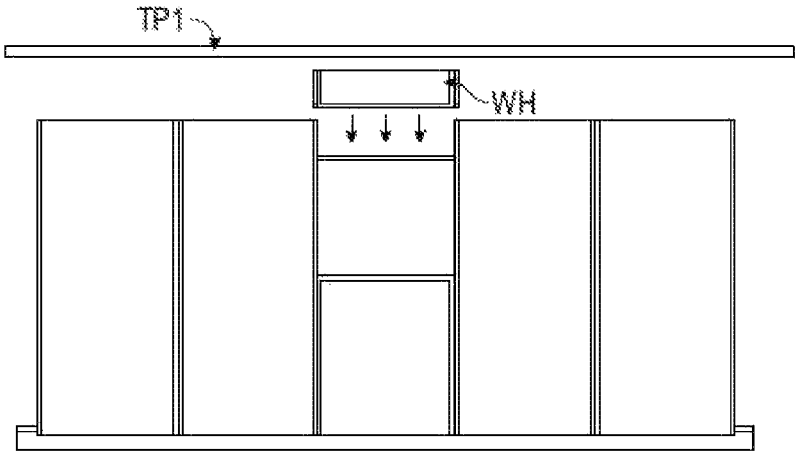

Referring to FIGS. 19A to 19D, a method for installation of a window in the presently described building system 1000 involves positioning a window sill panel WS. The window sill panel WS may have a similar configuration as panels 100 with respective channels along top, bottom and sides of the panel 100. FIG. 19A depicts an exploded view of the window installation. The window opening is defined by window channels (top, bottom, left and right). Referring to FIG. 19B, the upright connectors 700 are positioned adjacent a fixed panel 100A. Specifically, the lower portion 700B is fastened to the bottom plate 20. The next step involves fixing the upright connectors 500' onto either lateral side of the window header WH before positioning the window header above the top window channel. The bottom window channel (also referred to as the window sill channel-WSC) is positioned above the window sill panel WS and the upper portions of each of the upright connectors 700 is fastened to window side channel by using screws (not shown). The subsequent step shown in FIG. 19C involves ensuring that the window's side channels (left channel in particular) is in position adjacent to the fixed panel 100A before inserting the top window side channel WSC. The other panel 100B is then positioned in place (shown in FIG. 19C) before positioning the window head unit WH above the top window side channel. The top plate TP-1 is positioned above and across the window header WH, the upright connectors 500' and the panels 100A and 100B.

Figure 20:
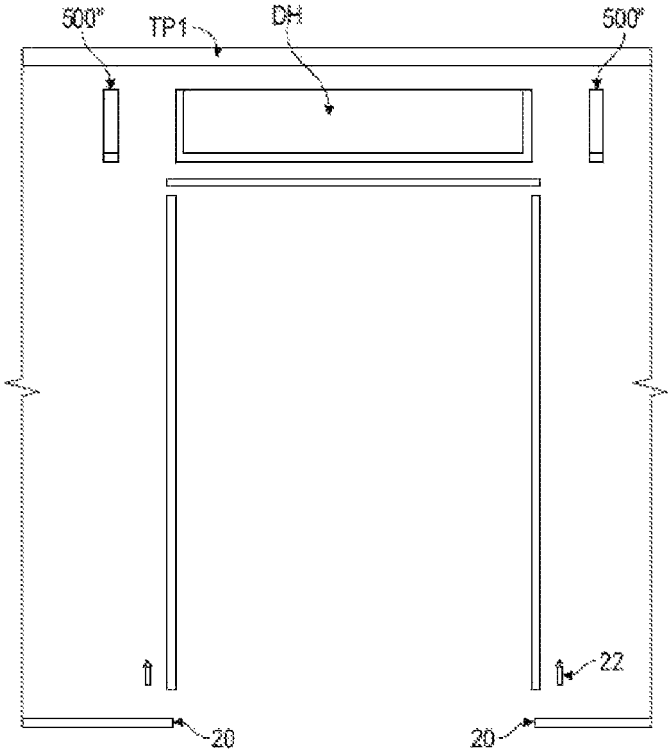
FIG. 20 is an exploded view of a door opening utilising upright connectors 500".
Figure 21:
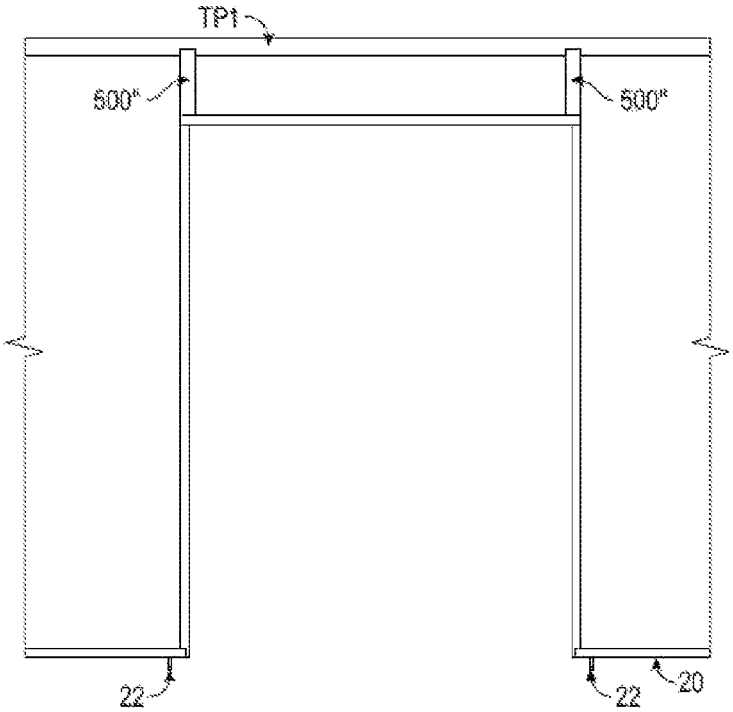
FIG. 21 is a frontal view of the door opening utilising upright connectors 500".
Figure 22A:
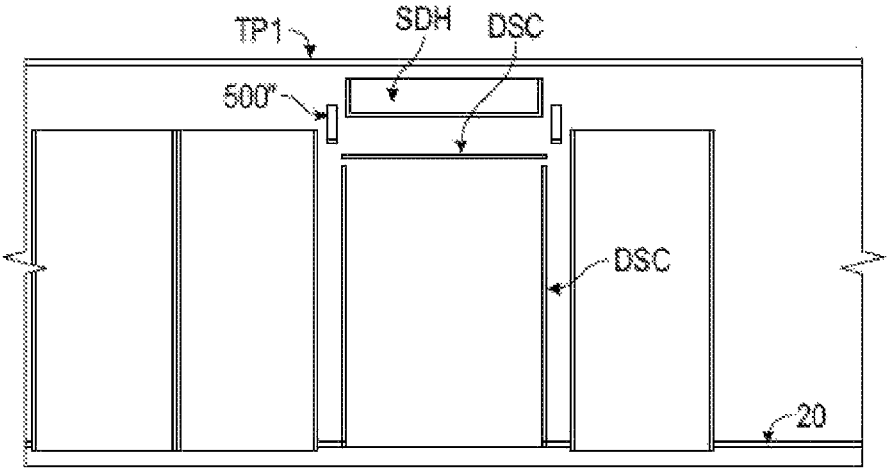
FIGS. 22A to 22D illustrate a method for installing a window opening by utilising upright connectors 500".
Figure 22B:
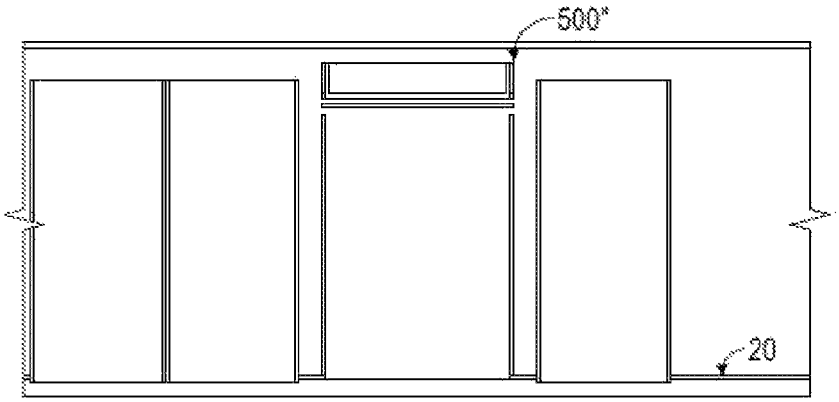
Figure 22C:
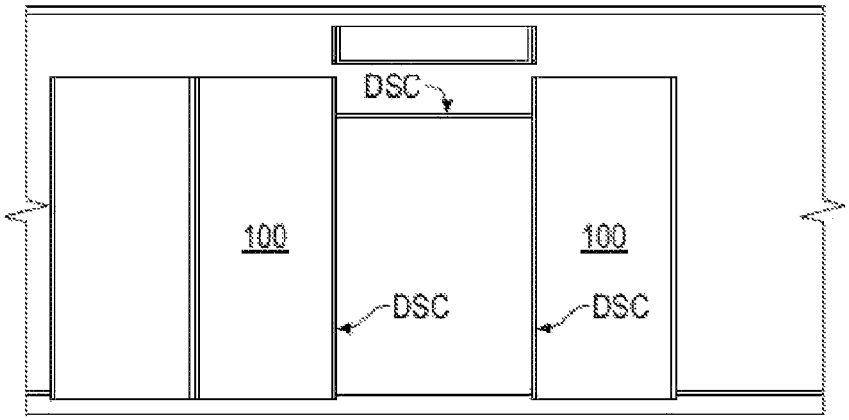
Figure 22D:
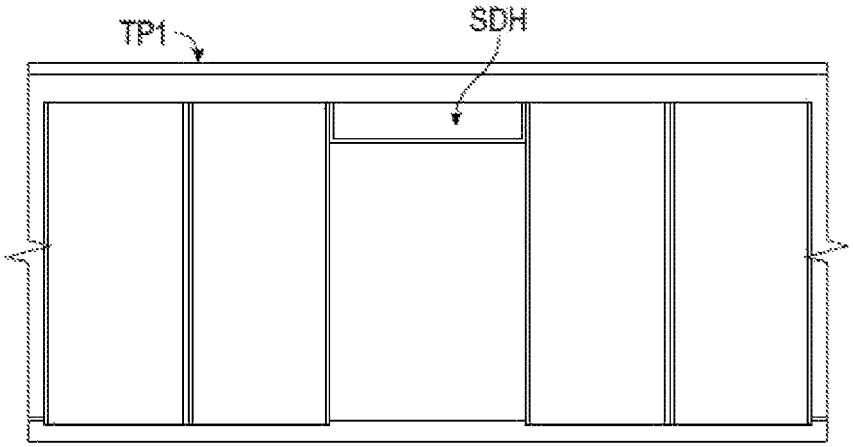

Referring to FIGS. 20 to 22 (22A to 22D), another embodiment of an upright connector 500" is illustrated. The upright connector 500" is structurally similar to previously described connector 500 and is particularly suitable for installing a sliding door during modular construction of the modular building system 1000. Each upright connector 500" comprises sidewalls extending between an in-use upper portion 500"A and an in-use lower portion 500"B. Each of the upper portions 500" include spaced apart portions (similar to spaced portions 512 and 514) that are adapted for receiving a top plate such as TP-1 as shown in FIGS. 20 and 21. Lower portions of the upright connector 500" include male connecting members that are structured to be received into a channel of the top door supporting channel (DSC) member. The opening for the sliding door is defined by the top door supporting channel DSC and two side door supporting channels as shown in FIGS. 20 and 21. Referring to FIGS. 22A to 22D, the method for installation of a door in the presently described building system 1000 involves positioning the door supporting channels (top and side DSCs) to define the opening of the sliding door. This initial step (FIG. 22A) is followed by fixing upright connectors 500" to either lateral side of the sliding door header (SDH) as shown in FIG. 22B. The third step involves pushing each of the side DSCs into the side channels of the spaced apart fixed panels 100 as shown in FIG. 22C and fixing the top DSC by pushing the top DSC to be in engagement with the respective top portions of the side DSCs. The final step (shown in FIG. 22D) involves inserting the SDH panel above the top DSC before positioning the top plate TP-1 across and above the panels 100, the SDH and the top portions of the upright connectors 500".

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

What is claimed is:

1. A modular building construction system comprising a plurality of panels, each panel having two spaced apart sheets; an insulating core portion positioned between said spaced apart sheets, wherein edge portions of the spaced apart sheets define hollow cavities, the cavities extending along peripheral portions of the panel wherein the panel comprises a length (l) and a height (h) wherein top and bottom channel members face outwardly and extend along the length (l) of the panel and are positioned in the respective hollow cavities along the peripheral portions of the panel respectively; and wherein first and second opposite side channels face outwardly and extend along the height (h) of the panel and are positioned in respective hollow cavities along each of the lateral peripheral portions of the panel respectively and wherein during use the channel members are adapted to be interconnected with one or more building elements positioned along said peripheral portions;

wherein the spaced apart sheets and the insulating core are substantially non-metallic and wherein the channel members are substantially metallic; and wherein the metallic channel members are adhesively bonded to the core portion and/or the opposed sheets;

wherein the one or more building elements comprises an upright connecting assembly adapted to be received into the opposite side channels, the upright connecting assembly comprising:

an upright with one or more outer side walls extending between an in use-upper portion and an in use-lower portion along a height of the upright;

the upper portion further comprising an upwardly extending connecting arrangement with spaced apart portions to allow a beam to be positioned transversely relative to the upright; and the lower portion further comprising a downwardly extending male connecting member structured to be received into a channel of an in-use bottom plate positioned below said assembly.

2. A modular building system in accordance with claim 1 wherein the upright is adapted to be received in the side channels of the panels in adjacent side by side relationship wherein during use the upright is adapted to be fastened to the side channels of the panels in said adjacent side by side relationship.

3. A modular building system in accordance with claim 1 wherein walls of the channel of the in-use bottom plate are adapted to be received into the bottom channel members of the panels and wherein during use the bottom channel members are fastened to the walls of the channel of the bottom plate.

4. A modular building system in accordance with claim 1 wherein the top channel members of the panels are adapted to receive the beam thereby allowing the beam to be positioned transversely relative to the upright and wherein during use, the top channel members of the panels are fastened to the beam.

5. A modular building system in accordance with claim 1 wherein the upright comprises a substantially hollow configuration.

6. A modular building system in accordance with claim 1 wherein the upright comprises a substantially rectangular configuration with first and second pairs of opposed side walls extending along the height of the upright.

7. A modular building system in accordance with claim 5 wherein the spaced apart portions extend upwardly from the upper portion of the upright to define a space there-between and form the connecting arrangement to receive and support the beam in the transverse position relative to the upright.

8. A modular building system in accordance with claim 1 wherein the upright connecting assembly further comprises the downwardly extending male connecting member, said male connecting member being inwardly recessed relative to the side walls of the upright.

9. A modular building system in accordance with claim 1 wherein the male connecting member comprises connecting side walls depending downwardly from the upright, the connecting side walls being stepped or recessed inwardly relative to the outer side walls of the upright.

10. A modular building system in accordance with claim 9 wherein the male connecting member comprises at least two of said connecting side walls, wherein said two connecting side walls are spaced apart.

11. A modular building system in accordance with claim 10 wherein the spaced connecting sidewalls are joined by an additional connecting side wall extending there-between.

12. A modular building system in accordance with claim 10 wherein each connecting side wall of the male connecting member lies in a plane that is parallel to a plane of the one or more outer side walls of the upright.

13. A modular building system in accordance with claim 1 wherein the upright comprises a first elongate upright member comprising a substantially U-shaped profile that is received lengthwise in a second elongate upright member.

14. A modular building system in accordance with claim 13 wherein the second elongate upright member also comprises a substantially C-shaped or U-shaped profile.

15. A modular building system in accordance with claim 14 wherein each of the first and second upright member comprises two opposed side walls and a base wall such that the opposed side walls extend from the base wall and wherein each of said opposed side walls and base wall of the respective upright member extend along the height of the upright.

16. A modular building system in accordance with claim 15 wherein each of the opposed side walls of the upright are substantially perpendicular to the base wall of the upright.

17. A method of modular building construction by using a plurality of panels, each panel having two spaced apart sheets; an insulating core portion positioned between said spaced apart sheets, wherein edge portions of the spaced apart sheets define hollow cavities, the cavities extending along peripheral portions of the panel wherein the panel comprises a length (l) and a height (h) wherein top and bottom channels face outwardly and extend along the length (l) of the panel and are positioned in the hollow cavities along the in-use top and bottom peripheral portions of the panel respectively; and wherein first and second opposite side channels face outwardly and extend along the height (h) of the panel and are positioned in respective hollow cavities along each of the lateral peripheral portions of the panel respectively, the method comprising the steps of:

positioning a bottom plate on an underlying building surface upon which the modular building is to be constructed, the bottom plate comprising upstanding walls defining a channel;

securing said bottom plate to the underlying building surface;

positioning the upstanding walls of the bottom plate in engagement with the bottom channel and fastening the bottom channel to the bottom plate using one or more fasteners;

providing an upright connecting assembly in between the side channels of the panels in adjacent side by side relationship; and fastening said upright connecting assembly to the side channels of the panels in said adjacent side by side relationship;

wherein the upright connecting assembly comprises an upright with one or more outer side walls extending between an in use-upper portion and an in use-lower portion along a height of the upright; the upper portion further comprising an upwardly extending connecting arrangement with spaced apart portions to allow a beam to be positioned transversely relative to the upright; and the lower portion further comprising a downwardly extending male connecting member structured to be received into the channel of the bottom plate.

18. A method in accordance with claim 17 further comprising the step of:

positioning the beam in between the spaced apart portions in a transverse configuration relative to the upright such that one or more sections of the beam are also received into one or more of the top channels of the panels in adjacent side by side relationship; and fastening the beam to the one or more top channels.

* * * * *